US005993166A

United States Patent [19]

Huntley

[11] Patent Number: 5,993,166

[45] Date of Patent: Nov. 30, 1999

[54] DIFFUSION PUMPS HAVING AN INTEGRATED RESERVOIR FOR THE WORKING FLUID

[75] Inventor: Graeme Huntley, Crawley, United Kingdom

[73] Assignee: The BOC Group plc, Windlesham, United Kingdom

[21] Appl. No.: 08/919,669

[22] Filed: Aug. 28, 1997

[30] Foreign Application Priority Data

Aug. 28, 1996 [GB] United Kingdom ..... 9617887

[51] Int. Cl.[6] ..... F04F 9/00

[52] U.S. Cl. ..... 417/152; 417/77; 417/208

[58] Field of Search ..... 417/77, 207, 208, 417/152

[56] References Cited

U.S. PATENT DOCUMENTS

| | | | |
|---|---|---|---|
| 1,439,810 | 12/1922 | Girdwood | 417/77 |
| 1,501,071 | 7/1924 | Snook | 417/152 |
| 2,465,590 | 3/1949 | Hickman | 417/152 |
| 2,763,246 | 9/1956 | Raskin | 417/208 |
| 3,686,474 | 8/1972 | Power | 417/208 |
| 4,201,629 | 5/1980 | Buggele . | |

FOREIGN PATENT DOCUMENTS

| | | | |
|---|---|---|---|
| 1 326 796 | 8/1963 | France . | |
| 2 666 384 | 3/1992 | France . | |
| 93/17242 | 9/1993 | WIPO | 417/152 |

*Primary Examiner*—Charles G. Freay
*Assistant Examiner*—Cheryl J. Tyler
*Attorney, Agent, or Firm*—David M. Rosenblum; Salvatore P. Pace

[57] ABSTRACT

A diffusion pump having a hollow outer body and a heater to heat working fluid that is used in the pump. The hollow outer body includes an outlet for connection to a backing pump and an inlet for communication with the chamber to be evacuated. A sump contains the working fluid and a reservoir for the working fluid surrounds the sump as an integral part of the hollow body. The surrounding reservoir decreases service intervals and reduces heat up and cool down time. The reservoir can be formed of two cylindrical surfaces concentric with the central axis of the pump.

3 Claims, 2 Drawing Sheets

DIFFUSION PUMPS HAVING AN INTEGRATED RESERVOIR FOR THE WORKING FLUID

BACKGROUND OF THE INVENTION

The present invention relates to vacuum pumps of the type known as diffusion pumps.

Diffusion pumps are well known and widely used for the attainment of high and ultra high vacuum. When used with modern working fluids and accessories, they can produce pressures approaching $10^{-10}$ mbar. The pumps are generally incapable of exhausting directly to the atmosphere and require the use of a backing pump, commonly an oil sealed rotary vacuum pump, in conjunction with the diffusion pump itself.

Diffusion pumps generally comprise a substantially cylindrical outer body which is cooled by, for example, coils helically wound around the outside of the body through which cooling water can be circulated or alternatively by air cooled fins attached to the outside of the body.

Within the outer body is positioned a hollow "chimney" sitting at, or close to, the base of the outer body and which tapers (continuously or, more usually, in stages) upwardly from the base. The chimney is generally contained within the outer body and is positioned substantially concentrically therein.

Across the top of the chimney but not in contact therewith is a top cap having a generally circular portion of somewhat larger diameter than the top of the chimney and positioned symmetrically with regard to the chimney and having a downwardly projecting annular side portion whose lower edge is somewhat beneath the upper edge of the chimney. The top cap is therefore substantially an inverted "cup shaped" component positioned about the top of the chimney with a circular or annular passageway therebetween. The top cap and the adjacent portion of the chimney defining the annular passageway is known as a 'jet stage'. A heater is provided adjacent the base of the outer body and, prior to use of the pump, a working oil is placed in the base of the body to a height above the lower edge of the chimney positioned within the body. The oil is usually a low vapour pressure oil although some versions of diffusion pumps use mercury.

A pump inlet is positioned in the outer body above the top cap and an outlet in the side of the body towards the base of the chimney but above the oil level. The outlet is normally connected to a backing pump as described above.

In use of pumps of this type, the backing (rotary) pump is turned on and left running continuously, a pressure of at least 0.1 mbar being required on the exhaust side of the diffusion pump. The cooling system (water or air) for the outer body is turned on and the oil can now be heated by the heater for, for example, fifteen to twenty minutes, when it begins to boil. Hot vapour rises up the chimney and forms (aided by the taper) a relatively high oil pressure at the top of the chimney. The vapour is then urged through the passageway between the chimney and the top cap, the jet stage, to an area of much lower pressure and creates an annular vapour jet. This jet is designed to move at a velocity which is supersonic and which impinges on the inside surface of the cooled outer body where the vapour condenses and condensed oil flows down the inside wall of the outer body and returns to the oil reservoir at the base of the body.

With the diffusion pump turned on, gas molecules being pumped in to the inlet of the diffusion pump are likely to collide with the much heavier oil vapour molecules and be provided with a velocity component which will direct the gas molecules towards the outlet of the diffusion pump where they will be subsequently removed from the diffusion pump via the backing pump. A pressure difference is thereby established across the continuously flowing vapour jet.

SUMMARY OF THE INVENTION

It is an aim of the present invention to provide a diffusion pump with an integral oil reservoir with a view to increasing the interval between services.

According to the present invention, a diffusion pump comprises a hollow outer body including an outlet for connection to a backing pump, an inlet for communication with a chamber to be evacuated, a sump for containing a working fluid and means for heating the working fluid when present in the base and is characterised by a reservoir for the working fluid integral with the hollow outer body.

BRIEF DESCRIPTION OF THE DRAWINGS

An embodiment of the invention will now be described, by way of example reference being made to the Figures of the accompanying diagrammatic drawings in which.

DETAILED DESCRIPTION

Figure 1:
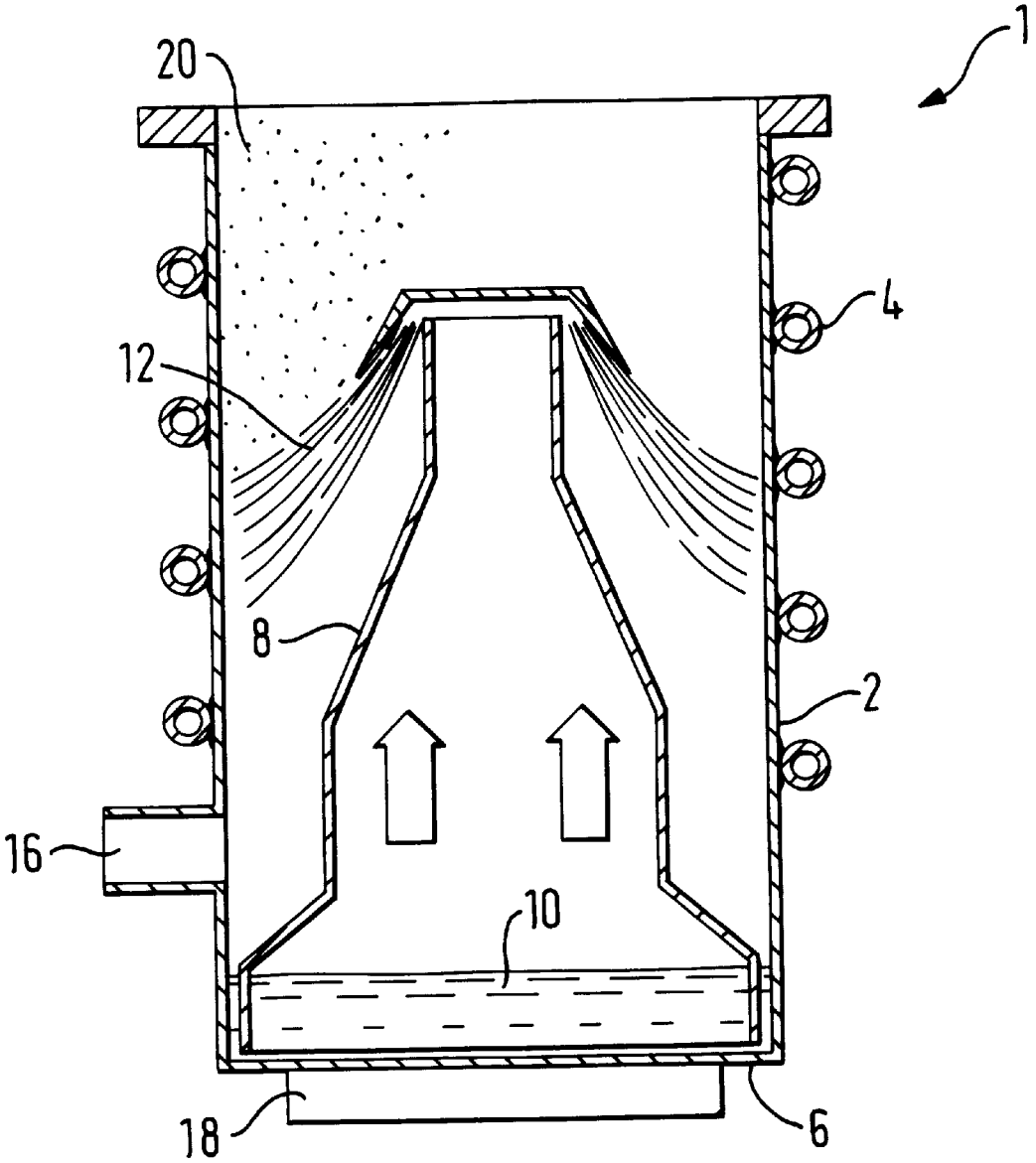
FIG. 1 is a cross section through a diagrammatic representation of a typical known diffusion pump.

As shown in FIG. 1, a diffusion pump 1 comprises a hollow outer body 2 of circular cross-section, a major portion of which is provided with cooling coils 4. The body 2 includes a base 6 and a vapour chimney 8 is positioned within the outer body 2 such that its base portion 10 fits accurately within the base 6 creating an annular gap connecting to the lower portion of the base. A working fluid is located in the base portion 10 of the chimney 8 and a heater 18 is located adjacent the base 6.

As shown, the chimney 8 is formed with a jet stage 12.

The diffusion pump 1 also includes an outlet 16 for connection to a backing pump and an inlet 20 to which (by means not shown) a chamber/compartment to be evacuated is attached. The inlet 20 as shown is located adjacent the jet stage 12.

Figure 2:
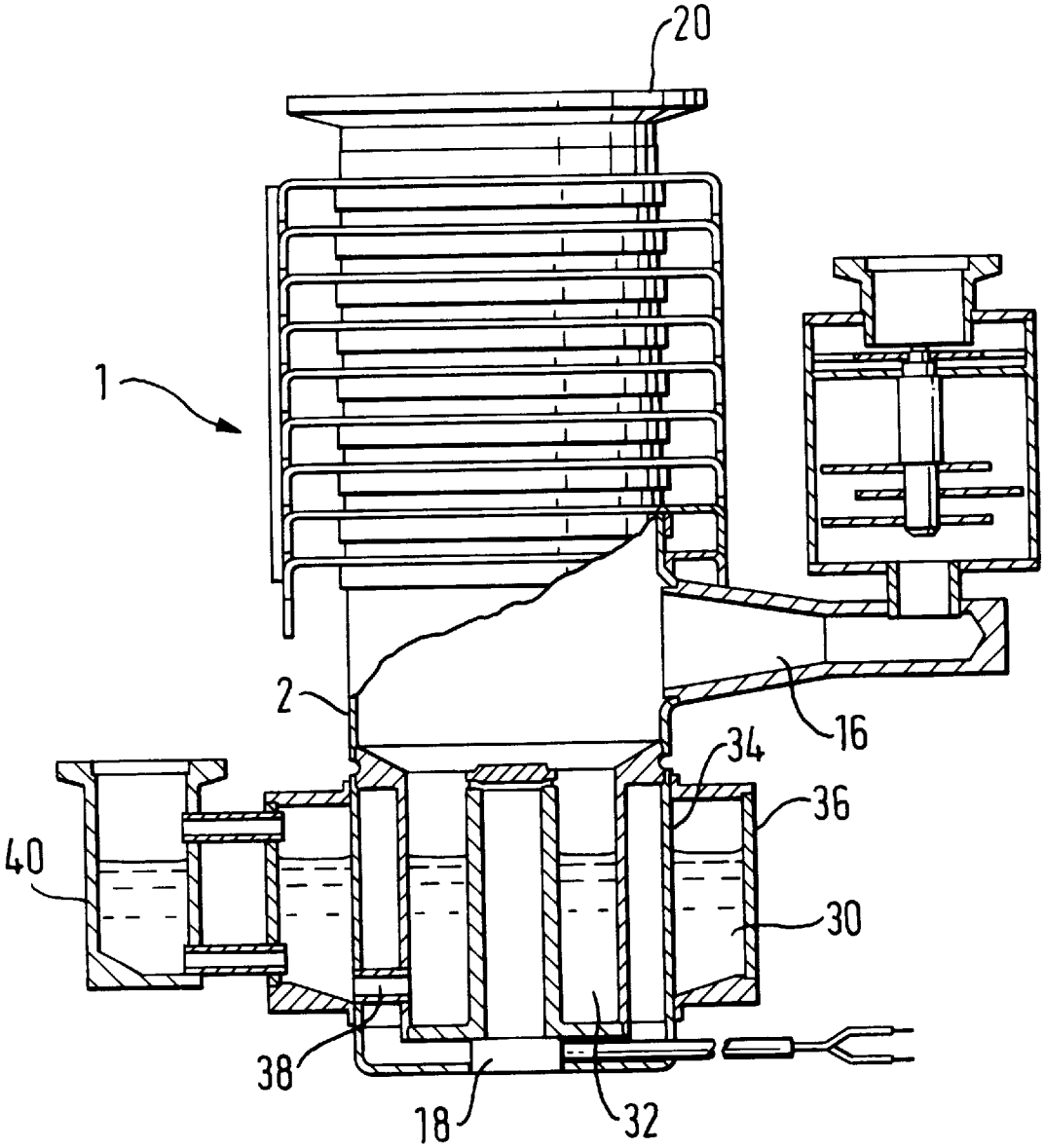
FIG. 2 is a view partly in cross section of a diffusion pump incorporating an integral oil reservoir according to the present invention.

Referring now to FIG. 2 which illustrates a diffusion pump 1 provided with a reservoir 30 for the working fluid arranged integral with the hollow body 2. As shown, the base 10 of the chimney 8 is formed as a sump 32 for the working fluid which in use, is heated by the heater 18 to cause vapour to rise up the chimney 8 in a manner known per se and to emerge through the jet stage 12. The fluid, thereafter falls downwards, in the general direction of the sump 32 along the inner surface of the body 2.

According to the present invention, the reservoir 30 for the working fluid is formed integral with the hollow body 2 and comprises two cylindrical surfaces 34,36 concentric with the pump axis between which reserve oil/working fluid is stored. As shown, the reservoir 30 communicates with the sump 32 by means of a small bore duct 38.

A particular advantage of the reservoir 30 is that according to its dimensions and those of the sump 32 it can increase the service interval of the diffusion pumps by up to a factor of six.

In one embodiment only one sixth of the total working fluid charge in a diffusion pump was used at any one time, the remaining five sixths being retained in the reservoir 30. This means that the heat up and cool down times for the pump were very low.

As shown a filler 40 is arranged to enable the reservoir 30 to be topped up when appropriate.

What is claimed is:

1. A diffusion pump comprising:

a hollow outer body including an outlet for connection to a backing pump, an inlet for communication with a chamber to be evacuated, a sump for containing a working fluid, and a reservoir containing said working fluid and surrounding the sump forming an integral part of the hollow outer body; and means for heating the working fluid when present in the base.

2. The pump according to claim 1 in which the hollow body portion has a chimney, a base of said chimney is formed as said sump for the working fluid and said heating means comprises a heater to cause vapour to rise up the chimney and emerge through a jet stage and thereafter fall downwards in the general direction of the sump along an inner surface of the body.

3. The pump according to claim 1 in which the reservoir for the working fluid comprises two cylindrical surfaces concentric with a central axis of the pump and between which working fluid is stored.

* * * * *